United States Patent [19]

Haneda et al.

[11] Patent Number: 4,499,169

[45] Date of Patent: Feb. 12, 1985

[54] DEVELOPING METHOD

[75] Inventors: Satoshi Haneda; Masahiko Itaya; Makoto Tomono, all of Hachioji, Japan

[73] Assignee: Konishiroku Photo Industry Co., Ltd., Tokyo, Japan

[21] Appl. No.: 448,180

[22] Filed: Dec. 9, 1982

[30] Foreign Application Priority Data

Dec. 22, 1981 [JP] Japan ..... 56-208691

[51] Int. Cl.[3] ..... G03G 13/09

[52] U.S. Cl. ..... 430/102; 430/122; 118/657; 118/658

[58] Field of Search ..... 430/102, 122; 118/657, 118/658

[56] References Cited

U.S. PATENT DOCUMENTS

| | | | |
|---|---|---|---|
| 4,299,900 | 11/1981 | Mitsuhashi et al. | 430/122 |
| 4,336,318 | 6/1982 | Fukumoto et al. | 430/122 X |
| 4,376,813 | 3/1983 | Yuge et al. | 430/122 X |
| 4,385,829 | 5/1983 | Nakahata et al. | 118/658 X |

FOREIGN PATENT DOCUMENTS

| | | | |
|---|---|---|---|
| 54-155043 | 12/1979 | Japan | 430/102 |
| 55-118049 | 9/1980 | Japan | 118/658 |
| 56-78846 | 6/1981 | Japan | 118/657 |

OTHER PUBLICATIONS

Whittaker, "A Magnetic Brush Developer Roll Employing a Sinusoidal Magnetic Field", Xerox Discl. Jour., vol. 1, No. 2, Feb. 1976, p. 39.

*Primary Examiner*—Roland E. Martin

*Attorney, Agent, or Firm*—Jordan B. Bierman

[57] ABSTRACT

The invention is directed to a developing method for electrophotography in which an insulating magnetic toner contacts an electrostatic image carrier to develop an electrostatic latent image. A magnetic bias is applied to restrain movement of the magnetic toner toward the image carrier and an alternating electric field is applied to the toner, all subject to the condition $V/d \geqq 0.1\nu$ in which V represents the effective voltage impressed upon the toner, d represents the clearance in millimeters between the image carrier and a developing sleeve, and $\nu$ represents the frequency in kilohertz of the alternating electric field.

9 Claims, 5 Drawing Figures

DEVELOPING METHOD

BACKGROUND OF THE INVENTION

The present invention relates to a developing method for electrophotography, and more particularly to a developing method wherein insulating toner is used and visible images which are excellent in the clearness of image, have no fog, and are rich in gradient can be obtained.

There has so far been known a jumping developing method wherein a one-component developer is used and the holder of such developer is positioned against the electrostatic image holder with a necessary clearance, and the development is made by the developer that flies over the clearance in an alternating electric field whose frequency is not more than 1 KHx (e.g. Japanese Patent Publication Open to Public Inspection No. 18656/1980). Further, there has been known the technology wherein a highfrequency pulse bias is impressed in the clearance between the electrostatic image holder and the developer holder confronting each other with such clearance, and thereby toners adhere to the image area of the electrostatic image holder but they do not adhere to the non-image area (e.g. U.S. Pat. Nos. 3,890,929, 3,866,574 and 3,893,418).

Such widely-known examples all employ one-component dry toner consisting of toner alone and utilize an arrangement wherein the electrostatic image holder and the toner holder are positioned to face each other with a clearance that requires a flying of toner such that an adherence of toner to the non-image area will be prevented.

Insulating toner, unlike conductive toner, has the great merit that it can be transferred to an untreated paper. One contact developing method has had a big problem from the occurrence of fog, though it has had merits such as (i) high speed developing is possible (ii) low voltage developing is possible and (iii) toner scattering is less compared with a non-contact developing method seen in a jumping development. The reason for this is that the insulating toner tends to adhere to the electrostatic image owing to its charge-induction property, residual voltage and triboelectrification because the insulating toner has an electric charge. As a fog-removing means, on the other hand, means using a magnetic force is generally employed. Strong magnetic bias can remove the fog but only from the edge portion of the image or from the low voltage portion; on the other hand, toner adheres from the scattering thereof and as a result the images lack the desired clearness and sharpness. If, on the other hand, a strong scraping force is used, the aforesaid clearness and sharpness are improved but the image quality in the developing direction will deteriorate due to the scattering of toner and the scraping force in the developing direction, which is a drawback.

SUMMARY OF THE INVENTION

The present invention offers a developing method characterized in that it has a magnetic bias that is set so that the adherence of toner to an electrostatic image carrier in the nonimage area is prevented and, has an electric bias that forms an alternating electric field at the developing section, in the developing method wherein an electrostatic image is visualized with an insulating magnetic toner contacting the electrostatic image carrier. Namely, the present invention has resulted from the discovery that there is a condition under which toner grains are vibrated by the aforesaid alternating electric field and thereby a clear and sharp image is formed on the image area alone, and adherence of developer to the non-image area does not substantially take place.

In the present invention, insulating toner is used and such toner is contacted indiscriminately on the image area where toner adheres to become visual, and on the non-image area where toner should not originally adhere both on the electrostatic image carrier and at the same time. Under the conditions proposed so that the magnetic force generated from a developer carrier prevents the adherence of toner to the non-image area, the alternating electric field is impressed between said developer carrier and the electrostatic image carrier, thereby said toner grains are vibrated by said alternating electric field and the image area alone is converted to clear and sharp images and the adherence of toner to the non-image area does not substantially take place.

DETAILED DESCRIPTION OF THE PREFERRED EMBODIMENTS

Figure 1:
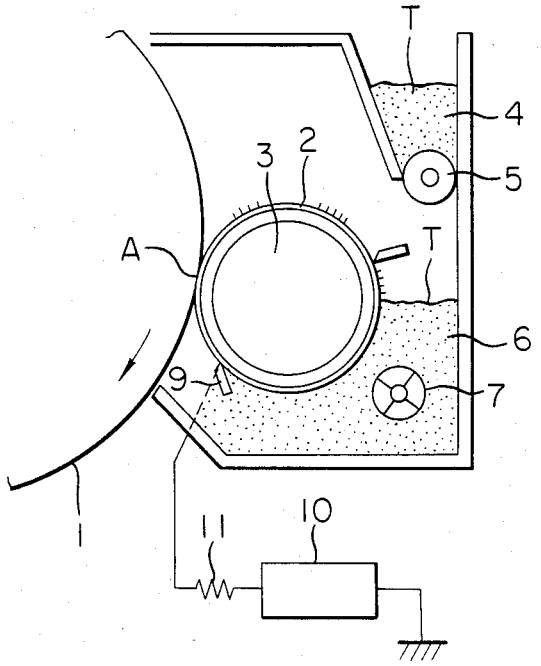
FIG. 1 and FIG. 4 show the structure of a developing apparatus that is an example of the present invention.

FIG. 1 shows a developing apparatus that is an example of the present invention. In the drawing, an electorstatic image carrier 1 in the form of a drum rotates in the direction of an arrow and at the developing area A on the peripheral surface thereof, there is arranged a non-magnetic cylindrical developing sleeve 2 that rotates in a direction opposite to that of the electrostatic image carrier 1 with a clearance of preferably 0.3 mm. It is desirable that this clearance is maintained within a range of 0.1–1.0 mm. The peripheral speed for rotation of the cylindrical sleeve 2 is similar to or faster than that of the electrostatic image carrier 1 and the cylindrical sleeve 2 is driven by known driving means (not shown).

As an example, the peripheral speed of the electrostatic image carrier 1 wherein selenium is employed as a photoconductor was set to 180 mm/sec, the outside diameter of the cylindrical sleeve 2 was set to 30 mm $\phi$ and the number of revolutions per minute thereof was set to 100 rpm. The selenium photoconductor was charged at 500 V through a corona charging and the light pattern was irradiated thereto, all by conventional means (not shown). The cylindrical sleeve 2 has a magnetic roll 3 inside thereof and each magnetic pole therein (not shown) has 900 gauss and they are magnetized alternately and rotate at 1000 rpm. The magnetic flux density should to be equal to or more than 500 gauss and 1500 gauss is sufficient.

It is desirable that the magnetic bias is set so that the adherence of toner to the non-image area will be prevented apart from the image quality on the image area when the development is made under the condition that the alternating electric field by a power source 10 is not applied. By setting the magnetic bias in this manner, it was possible to obtain the clear and sharp visible image without fog when the development was made with an alternating electric field applied under the magnetic bias.

Namely, the magnetic bias was set so that the white paper with a reflection density of 0.03could be developed as an image with a reflection density that is not more than 0.05 (preferably 0.04) and under such magnetic bias, an alternating electric field was applied, thereby a visible image with a high image quality was obtained.

In the toner supplying hopper 4, there are contained insulating toner grains T preferably with an average grain diameter of 12μ having 33 wt% of magnetite that is a magnetic substance. It is desirable that the magnetic substance contained in the toner is in the range of 30–60 wt%.

The toner supplying hopper 4 has a roller 5 for replenishment at an opening portion located at the bottom thereof. Toner enters the dimples provided thereon (not shown) with the rotation of the roller 5 drop into a toner chamber 6 and thus the replenishment of toner is made. Toner in the toner chamber 6, is stirred by screw 7, and adheres to the peripheral surface of the cylindrical sleeve 2 and then is carried to the developing area A. A toner thickness regulating blade 9 regulates the thickness of the toner adhering to the peripheral surface of the cylindrical sleeve 2 to a desired value, and the cleaning blade 8 scrapes off toner adhering to the cylindrical sleeve 2 after the development is completed.

Numeral 10 is an alternating power source to impress an alternating voltage with 100 Hz–10 KHz on cylindrical sleeve 2 and this power source 10 is connected to cylindrical sleeve 2 through a protection resistance 11.

Regarding the relation between cylindrical sleeve 2 and magnet roll 3 shown in FIG. 1, it is possible to adopt a method wherein cylindrical sleeve 2 and magnet roll 3 rotate in the same direction, or a method wherein only the cylindrical sleeve rotates, and further a method wherein only the magnet roll rotates in addition to the method wherein they rotate in the opposite directions as illustrated.

Now, regarding the developing apparatus illustrated in FIG. 1, a statement will be made about the development and its effect produced by the generation of alternating electric field between the electrostatic image carrier 1 and the cylindrical sleeve 2 that serves as a developing electrode with the use of an insulating toner.

As stated above, an insulating one-component toner tends to produce fog and a magnetic bias is used to prevent it. Application of a direct electric bias in this situation does not play a positive role for obtaining clear and sharp images, since an electric direct current bias applied on the sleeve merely shifts the electric balance of the development which is a voltage relation between the electrostatic charge image and the cylindrical sleeve and toner including toner with an inverted polarity; therefore, the application of a DC bias of 200–300 V or more rather increases the likelihood of fog.

Figure 2:
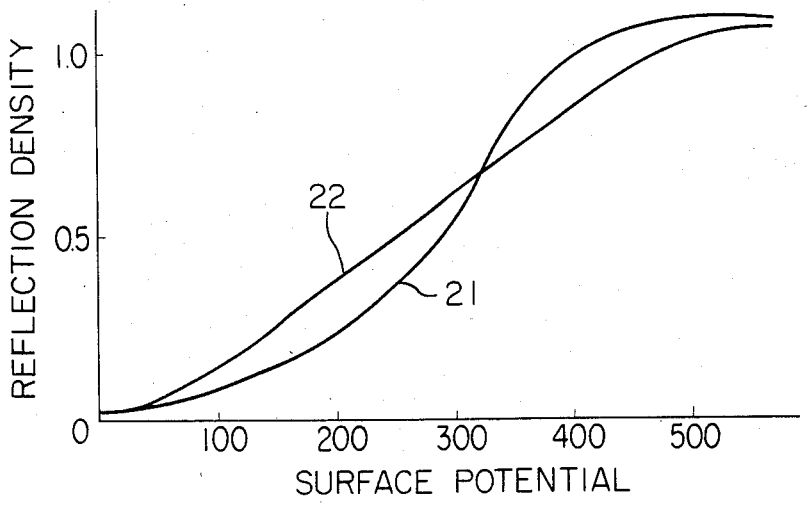
FIG. 2 shows the relation between the surface potential of the photosensitive receptor and the reflection density of an image.

It is a special feature of the present invention that the fog is prevented by the magnetic bias to be applied, while, the clear and sharp images can be obtained by the alternating electric field that accelerates the development. However, the alternating electric field can not be used without any restriction. FIG. 2 shows the relationship between the surface potential of a Se photosensitive receptor and the reflection density of the image transferred and fixed to the copy paper after the development. Specifically, curve 21 shows the relation between the surface potential and the reflection density under the condition of DC and AC biases which are 0 V (zero voltage), and curve 22 shows a relation between the surface potential and the reflection density under the alternating bias with AC 400 V and a frequency of 1500 Hz.

Figure 3:
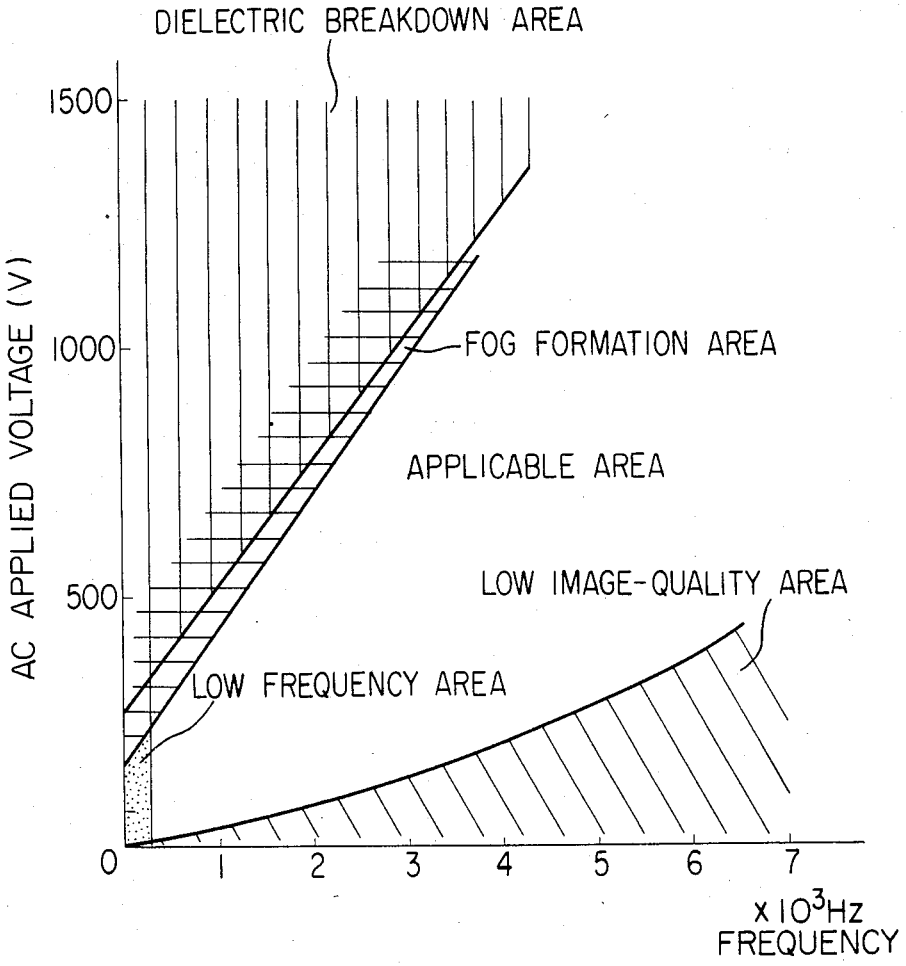
FIG. 3 and FIG. 5 show the optimum conditions for the development.

The sharpness and gradation of an image generally increase as the alternating electric field rises but at the same time, the fog tends to be produced. If the frequency is increased, on the other hand, the sharpness and gradation are lowered. Further, the developing area A, due to its narrow clearance, tends to have the dielectric breakdown if too high a voltage is impressed. For such reasons, there is a limitation on the intensity and frequency of the alternating electric field to be used for increasing the sharpness of the image, and the existence of the applicable developing area shown in FIG. 3 was experimentally ascertained. The dielectric breakdown area in FIG. 3 is an area where the dielectric breakdown takes place through the photosensitive receptor and the toner layer when a high voltage is impressed thereto. Further, the fog formation area is an area where toner adheres to the non-image area. This fog formation area naturally changes depending on the type and quantity of magnetic substance contained in the toner and on the magnetic bias caused by the magnetic force in the sleeve. The low image-quality area is an area where the effect of the alternate electric field is poor and thereby the image can not be sharpened. As stated above, reasonable conditions exist for good images to be obtained in the relation between the frequency, and the voltage to be applied and the existence of the applicable area shown in the clear area of FIG. 3.

Figure 4:
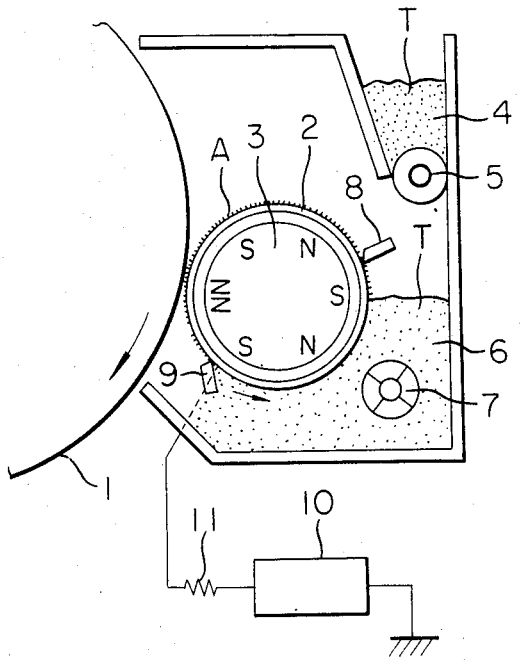

FIG. 4 shows a developing apparatus that is another example of the present invention. An electrostatic drum-shaped image carrier 1 rotates in the direction of the arrow and in the developing area A on the peripheral surface thereof, there is provided a non-magnetic cylindrical sleeve 2 that rotates in the same direction as that of the electrostatic image carrier 1 with a clearance of 0.5 mm. The clearance is preferably maintained at 0.1–1.0 mm. The peripheral speed for rotation of the cylindrical sleeve 2 is identical to that of the electrostatic image carrier 1 or higher than that and the cylindrical sleeve is driven by known driving means (not shown).

As an example, the peripheral speed of the electrostatic image carrier wherein a Se photosensitive receptor is used was set at 180 mm/sec, the outside diameter of the cylindrical sleeve 2 was set at 30 mm ϕ and the revolution per minute was set at 150 rpm. The Se photosensitive receptor was charged through the corona charging to be at 500 V and a light pattern was irradiated thereon. The cylindrical sleeve 2 is provided with a fixed magnetic roll 3 inside thereof and in the particular drawing, the magnetic poles at the developing area have the magnetic flux distribution whose both ends stand at 1200 gauss and a central portion stands at 800 gauss. Generally, the magnetic flux density needs to be 500 gauss or more and 1500 gauss is enough.

Inside the toner supplying hopper 4, there are contained insulating toner grains T with an average grain diameter of 15μ having 45 wt% of magnetite that is a magnetic substance. It is desirable that the magnetic substance contained in the toner is in the range of 30–60 wt%.

The insulating magnetic toner using the present invention is known, and the toner is prepared by various known methods. Typical examples of an insulating magnetic toner are disclosed in U.S. Pat. Nos. 4,164,476 and 4,259,427, and British Pat. No. 1,503,560 disclosing a preparation method for said toner.

The toner supplying hopper 4 provides with a roller 5 for replenishment at the opening portion located at the bottom thereof. Toners enter the usual dimples provided thereon with the rotation of the roller 5 and drop into the toner chamber 6; thus the replenishment of toner is made. Toner in the toner chamber 6, after being stirred by a screw 7, adhere to the peripheral surface of the cylindrical sleeve 2 and then are carried to the developing area A. The toner thickness regulating blade 8 regulates the thickness of the toner adhering to the peripheral surface of the cylindrical sleeve 2 to the certain value and a cleaning blade 9 removes toners adhering to the cylindrical sleeve 2 on which the development is completed.

Numeral 10 is an alternate power source to impress an alternate voltage with 100 Hz–10 KHz on cylindrical sleeve 2 and this power source 10 is connected to the cylindrical sleeve 2 through a protection resistance 11.

Regarding the relation between cylindrical sleeve 2 and magnet roll 3 shown in FIG. 1, they can rotate in the opposite direction each other as illustrated.

Figure 5:
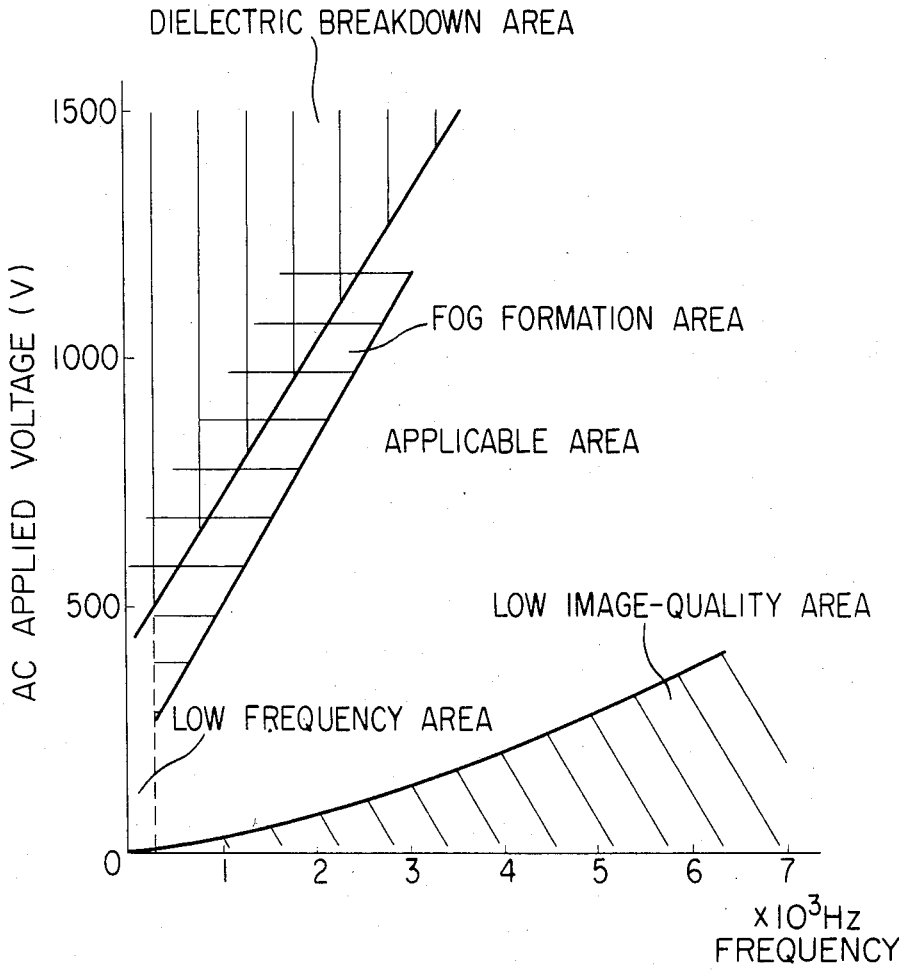

Regarding the developing apparatus illustrated in FIG. 4, the optimum zone similar to that in the case of FIG. 3 was obtained as shown in FIG. 5 concerning the development by the alternate electric field generating between the electrostatic image carrier 1 and the cylindrical sleeve 2 that serves as a developing electrode with the use of insulating toner, and the effect obtained by said development. The dielectric breakdown area in FIG. 5 is narrowed and this is considered to be caused by the fact that the clearance between the electrostatic charge image carrier and the cylindrical sleeve was widened compared with the case in FIG. 1 and the amount of magnetic substance contained in the toner was reduced.

As observed in the above examples, the effect of impression of the alternative bias voltage in the developing method wherein the development is made by a charged insulating magnetic toner contacting the electrostatic image carrier with the aid of an electrostatic image charge, is considered as follows.

As shown in FIG. 1 and FIG. 4, the insulating magnetic toners are attracted to the surface of the electrostatic image by the difference between the developed Coulomb force on the cylindrical sleeve and the magnetic force for the electrostatic image charge, but the toner contributing to the development is that part of the toner approaching the surface of the electrostatic image charge.

Now, the impression of an alternating bias voltage 10 on the cylindrical sleeve 2 that serves as the development electrode causes the insulating toner to be affected even by the alternating electric field. Each time the direction of impression of the alternating electric field changes, the direction of the force acting on the toner changes and toner moves in the direction corresponding to the above change. Here, the toner is also affected by the electric charge of the electrostatic latent image and as a result the toner faithfully reproduces the electrostatic latent image. Furthermore, the toner is vibrated by the alternating bias voltage and when the supply amount of toner is not enough, the toner that is more than that in the case of no alternating bias voltage touches the surface of the electrostatic image carrier and thereby the development can effectively be made and images with high density can be obtained. When the supplied amount of toner is excessive, on the other hand, the toner that is less than that in the case of no alternating bias adheres, and thereby a stable development is made. The improvement of gradation, on the other hand, is made by the impression of the alternating electric field as is shown on the curve 22 in FIG. 2 and said impression indicates that aspect wherein the development is made by the aid of the toner whose amount of electric charge is greater due to the alternating electric field. This can be explained by the fact that a toner is given a vibration by the alternating bias voltage. Each toner does not naturally exist in the developing unit with a constant amount of electric charge, but the amount of electric charge is distributed, and even a toner having an inverted polarity may partially exist. Developed toner has a high amount of electric field such as several $\mu c/g$, and toner developed under the alternating electric field had a tendency to show the greater value than the above. This indicates that the toner having a large amount of electric charge is selectively developed and the alternating electric field has the effect of increasing the selectivity. The following two factors are considered as a reason for the above effect caused by the alternating electric field.

(1) The toner having a large amount of electric charge vibrates more violently and thereby the chance for the development increases.

(2) The toner forms a cluster containing the toner with a small amount of electric charge, and said cluster is broken by the vibration and only the toner with a large amount of electric charge contributes selectively to the development.

Toner grains that adhere lightly and deteriorate an image are given a force by the alternating electric field and are shaken off or move to the high electric field section. Therefore, it is possible to obtain a visible image with a high sharpness. The movement of the toner is different from the flying of the toner in the jumping developing method, and it is a special feature that the movement of the toner is made with a toner layer and an electrostatic image carrier in contact with each other, and owing to the fact that the distance of the movement of the toner is substantially in the order of grain diameter of the toner which is small, the special effect resulting from the alternating electric field is extremely different from the condition for the jumping development (Japanese Patent Publication Open to Public Inspection No. 161252/1980) as seen in FIG. 3 and FIG. 5. Therefore, the developing method of the present invention can produce a toner image having excellent sharpness.

It is necessary that a high alternating electric field can be impressed on the insulating toner grains and it is desirable that the volume resistivity thereof is $10^{10}$ Ωcm or more, preferably $10^{12}$ Ωcm or more. The volume resistivity mentioned here is obtained by impressing a direct current voltage of 100 V on the toner layer with a thickness of 3–4 mm which is prepared by applying a load of 1 kg on the toner squeezed into a cross space of cylindrical form having a section of 1 $cm^2$. The alternating electric field to be impressed in the aforesaid examples may be any of a sine wave, a square wave, a triangular wave or a sawtooth wave. In the present invention, the frequency of 10 KHz or more can be used, but more is not preferable because of the loss of the power in an electric source and the use of high voltage. In the low frequency zone, on the other hand, a uniform development can not be produced at 100 Hz or less, because the traveling speed of the electrostatic image carrier is normally 100 mm/sec or more. Therefore, the preferable frequency zone to be used is 100 Hz–10 KHz. The results of experiments showed that the frequency zone effective for the sharpness of images was 100 Hz–10 KHz and the 1 KHz–5 KHz zone was especially preferable.

In the aforesaid examples, a square wave having 0 V as a central voltage was used, but an alternating bias voltage having a direct current component at about 200 V or so, for example, may be used.

The results of experiments mentioned above can be summarized in the experimental formula. From the results of experiments represented by FIG. 3 and FIG. 5, the optimum area of V/d that is the ratio of an effective voltage V (volt) including AC of the alternating electric field and having various wave forms and impressed on the toner layer to the distance d ($\mu$) between the electrostatic image carrier and the toner layer on the cylindrical sleeve is indicated in the constant relation with respect to the frequency $\nu$ (kilo hertz).

In order to exclude the low image-quality area, condition-1: $V/d \geqq 0.1\ \nu$ needs to be satisfied and under the condition of $V/d \leqq 0.1\ \nu$, the result of the development may lead to a low image quality lacking the sharpness.

In order to exclude the dielectric breakdown area and fog formation area, it is desirable that the condition-2: $V/d \leqq 1+\nu$ is satisfied. The effective voltage in the alternating electric field in this case is decided by the wave form as is widely known and in the case of a sine wave, the effective voltage is indicated as $$V = V_0/\sqrt{2}$$

where, $V_0$ is a maximum voltage of the sine wave. Under the condition of $V/d > 1+\nu$, the result of the development leads to fog formation, and a dielectric breakdown may likely take place in the high voltage portion where the photosensitive receptor and developers contact each other in the developing area; thus the image in that portion may be disturbed and lowered.

For the reasons mentioned above, it is preferable that the frequency $\nu$ (kilo hertz) satisfies the condition-3: $0.1 < \nu < 10$ and the condition-3': $1 \leqq \nu \leqq 5$ in particular.

With aforesaid conditions satisfied, namely, with the present invention, desirable results of the development can be obtained. Incidentally, the value V in FIG. 3 and FIG. 5 is the one in a case where the conductive sleeve is used, and the value of the voltage to be impressed on the toner layer may naturally be changed if an insulating or highly resistant sleeve is used.

In the present invention, as explained above, insulating and magnetic toners are used and the alternating electric field is generated between the electrostatic image holder and the holder of said toner under the development condition wherein the magnetic force from the toner holder prevents the aforesaid toner from adhering to the non-image area on the electrostatic image holder and toner grains are vibrated by aforesaid alternating electric field; thus the development is accelerated and thereby it is possible to obtain the sharp and excellent copied images with merits of the conventional contact development being utilized.

What is claimed is:

1. In a developing method in which an insulating magnetic toner contacts an electrostatic image carrier and an electrostatic image is developed on the carrier, and in which said developing method includes the step of impressing on the toner an alternating electric field that satisfies the following conditions, in combination with a magnetic bias operating to restrain the movement of the magnetic toner toward the image carrier:

condition-1: $V/d \geqq 0.1\ \nu$ condition-2: $V/d \leqq 1+\nu$ in which V represents the effective voltage impressed on the insulating magnetic toner, d represents the clearance in millimeters between the electrostatic image carrier and a developing sleeve, and $\nu$ represents the frequency in kilohertz of the alternating electric field.

2. The developing method according to claim 1, wherein said alternating electric field is a sine wave.

3. The developing method according to claim 1, wherein said effective voltage is represented by following condition:

$$V = V_0/\sqrt{2}$$

wherein V represents the effective voltage of a sine wave, and $V_0$ represents a maximum voltage of a sine wave.

4. The developing method according to claim 1, wherein said frequency ($\nu$) is between 100 Hz and 10 KHz.

5. The developing method according to claim 4, wherein said frequency ($\nu$) is between 1 KHz and 5 KHz.

6. The developing method according to claim 1, wherein the magnetic flux distribution of the developing area adjacent said image carrier is between 500 gauss and 1500 gauss.

7. The developing method according to claim 1, wherein said clearance is 0.1–1.0 mm.

8. The developing method according to claim 1, wherein the volume resistivity of said toner is not less than $10^{10}$ $\Omega$cm.

9. The developing method according to claim 8, wherein said volume resistivity is not less than $10^{12}$ $\Omega$cm.

* * * * *